US009499936B2

(12) United States Patent
Havird et al.

(10) Patent No.: US 9,499,936 B2
(45) Date of Patent: Nov. 22, 2016

(54) FLAME RETARDANT, COTTON/THERMOSET FABRICS

(75) Inventors: William D. Havird, Simpsonville, SC (US); David L. Tuggle, Chickamauga, GA (US); Michael E. Woods, Summerville, GA (US)

(73) Assignee: Mount Vernon Mills, Inc., Mauldin, SC (US)

( * ) Notice: Subject to any disclaimer, the term of this patent is extended or adjusted under 35 U.S.C. 154(b) by 715 days.

(21) Appl. No.: 12/803,713

(22) Filed: Jul. 2, 2010

(65) Prior Publication Data

US 2011/0065347 A1 Mar. 17, 2011

Related U.S. Application Data

(60) Provisional application No. 61/337,982, filed on Feb. 16, 2010, provisional application No. 61/276,748, filed on Sep. 16, 2009.

(51) Int. Cl.

| | |
|---|---|
| ***B05D 3/10*** | (2006.01) |
| ***D06M 13/285*** | (2006.01) |
| ***D06M 15/431*** | (2006.01) |

(52) U.S. Cl.

CPC ..... *D06M 13/285* (2013.01); *D06M 15/431* (2013.01); *D06M 2200/30* (2013.01); *Y10T 442/2672* (2015.04)

(58) Field of Classification Search

CPC ..... D06M 13/285; D06M 15/431; D06M 2200/30; Y10T 442/2672

USPC ..... 442/136, 141; 428/920, 921; 427/176, 427/173

See application file for complete search history.

(56) References Cited

U.S. PATENT DOCUMENTS

| | | | | |
|---|---|---|---|---|
| 3,637,409 | A * | 1/1972 | Hartman | 427/173 |
| 3,664,158 | A | 5/1972 | Skaathun et al. | |
| 3,771,952 | A | 11/1973 | Holm | |
| 3,891,386 | A | 6/1975 | Reid, Jr. et al. | |
| 4,051,699 | A | 10/1977 | Carpenter, Jr. | |
| 4,055,971 | A | 11/1977 | Hermes | |
| 4,062,289 | A | 12/1977 | McNair | |
| 4,062,989 | A | 12/1977 | Long | |
| 4,376,632 | A | 3/1983 | Codecasa | |
| 4,533,592 | A | 8/1985 | Bingham | |
| 4,557,968 | A * | 12/1985 | Thornton et al. | 442/198 |
| 4,717,391 | A | 1/1988 | Daniel et al. | |
| 4,842,609 | A * | 6/1989 | Johnson | 8/115.7 |
| 4,866,957 | A | 9/1989 | Daniel et al. | |
| 4,900,613 | A | 2/1990 | Green | |
| 4,909,805 | A | 3/1990 | Smith | |
| 4,941,884 | A | 7/1990 | Green | |
| 4,970,039 | A * | 11/1990 | Long | 264/136 |
| 5,102,726 | A | 4/1992 | Gabbay | |
| 5,252,386 | A * | 10/1993 | Hughes | D04H 1/492 442/136 |

(Continued)

OTHER PUBLICATIONS

Cotton Incorporated, Fabric Flame Retardant Treatment "Precondensate"/NH3 Process, Technical Bullletin TRI 4002, 2003, Cotton Incorporated, Cary, NC (USA).

*Primary Examiner* — Jeremy R Pierce

(74) *Attorney, Agent, or Firm* — Philip P. McCann; Smith Moore Leatherwood LLP

(57) ABSTRACT

A flame retardant fabric wherein a flame retardant composition is applied to the fabric while the fabric is being stretched. Preferably the fabric is a blend of cotton and a thermoset. Carbon fibers may be included to impart anti-static properties.

6 Claims, 1 Drawing Sheet

(56) References Cited

U.S. PATENT DOCUMENTS 5,468,545 A 11/1995 Fleming et al.
5,935,637 A * 8/1999 Caldwell et al. ..... 427/8
5,942,006 A * 8/1999 Cole ..... 8/111
7,168,140 B2 1/2007 McKee et al.
2005/0181124 A1 8/2005 Hoersch
2005/0272838 A1 12/2005 Yang et al.
2006/0030227 A1 2/2006 Hairston et al.
2007/0190872 A1* 8/2007 Weber ..... C09D 5/18 442/59
2007/0224902 A1* 9/2007 Hilleary ..... A41D 31/0022 442/301

* cited by examiner

FLAME RETARDANT, COTTON/THERMOSET FABRICS

CROSS REFERENCE TO RELATED APPLICATION

This application claims priority from U.S. provisional application Ser. No. 61/337,982, filed Feb. 16, 2010 having the same title and from U.S. provisional application Ser. No. 61/276,748, filed Sep. 16, 2009.

FIELD OF THE INVENTION

This invention relates to woven flame retardant fabrics and a method for treating such fabrics. Particularly, this invention relates to fabrics from which many types of garments are made including those that are worn by industrial workers, military personnel, or people engaged in recreational activities who may be exposed to hazardous conditions where sparks or flame might ignite their garments.

BACKGROUND OF THE INVENTION

One of the most widely used fibers for industrial garments is cotton because of its availability, cost, comfort, and the well-developed methods for spinning, weaving and knitting, and fabricating garments from it. However, because of the abusive working or recreational conditions that such garments may be subjected to, it has been found advantageous to blend the cotton fibers with other materials, such as thermoplastic fibers (such as nylon or polyester) or thermoset fibers (such as aramid fibers). One method for treating fabrics from such blended fibers to give them flame retardant characteristics is to treat the fabrics with an aqueous solution of an organo phosphorous compound such as tetrakis (hydroxyorgano) phosphonium compound especially with a tetrakis (hydroxymethyl) phosphonium which will be hereinafter called "THP". The use of such treatment compounds is summarized in Technical Bulletin TRI 4002 from Cotton Incorporated of Cary, N.C., Copyright 2003 entitled: *Fabric Flame Retardant Treatment "Precondensate"/NH3Process*. Among the many other examples in the prior art are U.S. Pat. No. 4,909,805 to Geoffrey W. Smith, U.S. Pat. No. 4,900,613 to James R. Green, and U.S. Pat. No. 5,468,545 to George R. Fleming, et al.

The process for using THP in an aqueous solution to treat fabrics of cotton blends to impart flame retardant characteristics as described in the above-mentioned Smith and Fleming patents begins when the fabric to be treated is dipped into a bath containing THP in a specified concentration and pulled therethrough.

Other methods to hold and convey fabrics in order to apply a variety of treatments include dyeing a fabric on a frame as shown in U.S. Pat. No. 4,717,391 by spraying the dye onto the fabric and coating as shown in U.S. Pat. No. 4,062,989 to Delmar D. Long, where fabric is held by a pin tenter frame to receive a coating layer and in U.S. Pat. No. 3,637,409 to Ludwig Hartman, where a non-woven fabric is coated and is impregnated with a flame retardant after being first stretched longitudinally followed by re-wetting and stretching transversely. In addition, in U.S. Pat. No. 4,051,699 to John Carpenter, a process is described where fabric is held on a pin drive to maintain tension while liquid ammonia is applied to the fabric. Accordingly, it is one object of the present invention to provide a novel method of treating a woven or knitted fabric with a flame retardant while being conveyed.

In US Patent Publication 2005/0272838 A1 to Charles Yang, et al. the treatment of cotton and/or cotton blends containing Nomex®, Kevlar®, nylon, and polyester fiber in a flame retardant material is described. The treatment employs a melamine-formaldehyde resin. Accordingly, it is another object of the invention to provide a woven or knitted fabric of novel cotton/thermoplastic/thermoset fiber blends which are treated by a unique method of applying flame retardant.

Another hazard encountered with apparel fabrics, particularly in cool, dry environments, is electrostatic discharge or "sparking." Also, many other environments can cause a buildup up of electrostatic charge because. of the proximity to high voltage lines or equipment. The inadvertent discharge or spark from a charged garment while the wearer is near a volatile substance can result in serious fire or explosion. In U.S. Pat. No. 4,557,968 to Thornton et al., issued Dec. 10, 1985, a directional electrostatic discharging fabric is described that employs carbon and polyester fibers with the purpose of conducting away any charge before it can build up. Accordingly, it is another object of the present invention to provide a garment that reduces the hazards of electrostatic buildup and discharge.

The foregoing and other objects are accomplished by the invention described below.

SUMMARY OF THE INVENTION

In one aspect, the present invention is a method of treating a woven or knitted fabric of cotton blended with a thermoset, or with a thermoplastic, or with both with a flame retardant composition comprising the steps of stretching the fabric up to 12% greater than its un-stretched dimensions and, while so stretched, applying a flame retardant to the fabric and then allowing the fabric to shrink back to its approximate original dimensions. The flame retardant may either be applied to the fabric or the fabric may be immersed in an aqueous bath containing flame retardants. The preferred flame retardant for an aqueous bath is THP but other suitable flame retardants may be used. The stretching may be longitudinal, transverse, or both longitudinal and transverse. However, transverse stretching is preferred and the preferred thermoset materials are the aramid and the para-aramid and meta-aramids. A preferred thermoplastic is nylon.

In another aspect, the present invention is a process comprising the steps of: providing a woven or knitted fabric having predominately cotton fibers and 10% to 30% meta-aramid fibers; dyeing the fabric; stretching the fabric from about 5% to about 12% greater than its initial width; immersing the stretched fabric in a bath containing a phosphorous polymer of THPS or THPC; squeezing the fabric after immersion to obtain a moisture pickup in the range of 80% to 120%; drying the fabric to a moisture content in the range of less than 8%, preferably to about 6% to 8%; treating the fabric with an ammonia gas; oxidizing the fabric with hydrogen peroxide and allowing the fabric to shrink back to and approach its pre-stretched dimensions. One novel feature of the invention is a flame retardant material with a thermoset fiber in the fill yarn.

In another aspect, the invention is a woven fabric comprising a blend of at least 60% cotton fibers with at least 10% meta-aramid fibers, said fabric being treated with a flame retardant in sufficient amount to meet the applicable Federal, state, and local regulations.

In another aspect, the fabric blend comprises 75% to 80% cotton and 20% to 25% meta-aramid; or in still another aspect, the fabric blend is 70% cotton and 20% meta-aramid and 10% nylon; or another thermoplastic; and in a still further aspect, the blend is about 70% cotton, 20% meta-aramid and 5% para-aramid. The preferred meta-aramid is the Nomex® polymer sold by DuPont and the preferred para-aramid is the Kevlar® also sold by DuPont.

In a still further aspect, the present invention is an industrial, military, or recreational apparel fabric that is not only flame retardant but also dissipates electrostatic charge. and has anti-static properties. To accomplish this, carbon/polyester filaments are preferably wrapped around the fill yarn. A particularly preferred filament is one with a carbon core surrounded by a polyester sheath.

The invention is applicable to knitted as well as woven fabrics, especially jersey, interlock and fleece knits.

DETAILED DESCRIPTION

Figure 1:
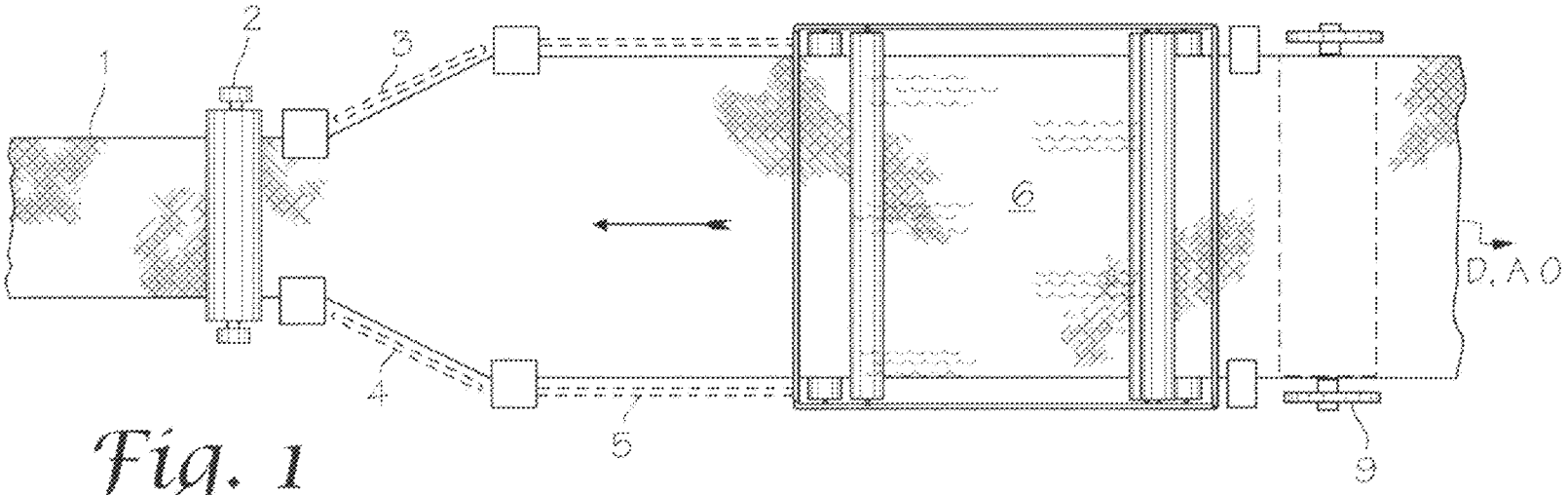
FIG. 1 is a top view of a schematic representation of the tenter frame stretching operation of the present invention as the fabric enters the dip tank for treatment; and, FIG. 2 is a side view representation showing the fabric as it is transported through the dip tank treating solution

Turning first to FIG. 1, a tenter frame layout is shown with woven or knitted fabric 1, which is preferably a fabric made from a blend of a major amount of cotton fibers and a minor amount of meta-aramid fibers, being fed through guide rollers 2, to tenter frame 3 where chain mounted pin or clip array 4 grips the edges of the fabric and stretches it transversely or in the fill direction to a width that is 4" to 7" greater than the un-stretched width which will be in the range of 60" to 70" so that stretching will be in the order of 5% to 12% greater than the original or initial width.

Figure 2:
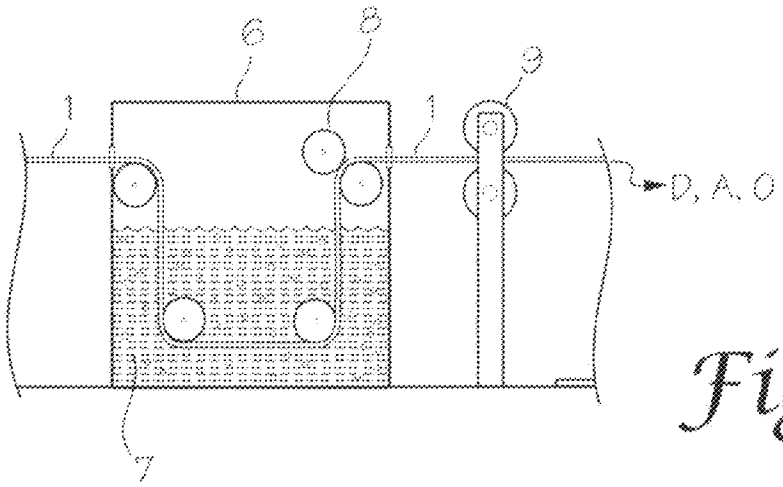

Referring now to FIG. 2, fabric 1 in its stretched condition enters dip tank 6 where it is immersed in treating solution 7 which is an aqueous solution having a THP concentration in the range from 25% to 40% by weight where the fabric picks up the treating solution. After leaving the dip tank 6 the fabric 1 passes through squeeze rollers 9 to reduce the "wet pickup" to about 80% to 120% of the fabric weight before entering the drying, ammoniating, and oxidizing steps known as D, A, and O.

In more detail, the steps of the preferred process begin with providing a fabric 1 woven with yarns that have a major amount of cotton and a minor amount of meta-amid fibers. A knitted fabric can also be subject to this same process. The fabric is first dyed (not shown) using vat or naphthol dyestuff and pH is controlled to be between 7.0 and 9.0. Next, the fabric is conveyed to a tenter frame where the edges of the fabric are held by pins or clips and the fabric is stretched from about 4 inches to about 7 inches over its original width.

While stretched, the fabric is immersed in an aqueous bath with a concentration of 25% to 40% of THPS (tretra kis hydroxymethyl phosphonium sulfate) or THPC (hydroxymethyl phosphonium chloride) to produce a concentration level of 1.5% to about 4.0% phosphorous content by weight in the finished fabric. Preferably, the bath concentration can be confirmed by chemical titration during treatment and the phosphorous content may be verified by X-ray analysis after treatment. "THP" broadly includes THPS and THPC.

After the fabric leaves the immersion bath, it is then squeezed through the nip or pad rollers to achieve a wet pickup of about 80% to 120% of the fabric by weight. The fabric is then dried in a forced air dryer followed by infrared heating. Moisture level after drying is preferably below 8% and more preferably the moisture level would be 6 to 8%.

Next, the fabric is bathed with ammonia gas in a controlled atmosphere chamber for a short period sufficient to cross-link the THP while the fabric is in the stretched position. Afterwards, the fabric is oxidized with hydrogen peroxide to stop the cross-linking process and then it is washed with a neutralizing soda solution. The treatment with ammonia followed by oxidation is well-known in the art and is described in detail in the above-mentioned patents to Smith and Fleming which are incorporated herein by reference. The fabric is now allowed to shrink back to its prestretched dimensions.

A novel feature of the present invention is that the fabric receives its flame retardant treatment while stretched. The stretching opens up the fabric so that the THP can penetrate the tightly twisted and woven yarns and contact the cotton fibers. This is unique and is advantageously accomplished with the assistance of thermoset fibers which are resilient and will stretch and then shrink back to pre-stretched dimensions. The shrink-back of the entire fabric is enhanced by the thermoset materials which then help the cotton to compress back to its original dimensions. The penetration of the THP deep into each cotton fiber of the yarn causes the THP to be evenly deposited in the fabric; and, while in this stretched position, the ammonia is applied so that it cross-links the evenly deposited THP. The subsequent application of the hydrogen peroxide will also evenly shut down the cross-linking process so that the degree of cross-linking is controlled and the fabric will not become unacceptably and unevenly stiff.

The finished fabric can be tested for flame resisted characteristics using the char length test according to ASTM D6413. After the testing, the fabric is washed according to Underwriters Laboratories 100 IL (industrial laundering) criteria and tested again for char length using the ASTM standard for comparison purposes to determine if the flame retardant compound tends to wash out. The char length resulting from the test will be less than the 6" maximum which is considered flame resistant under ASTM F1506.

The preferred fabric, according to the present invention, comprises 50 to 95% by weight of cotton fiber with the preferred percentage being 70 to 75%. The other fibers range between 5% and 30% of the weight of the fabric. All fibers should be the same length, typically 1¼" to 1½. These fibers are blended together in yarn manufacturing and are either blended together in both warp and fill yarns fabric or simply in with the warp yarn only or in fill yarns only. The balance of the fiber composition would be 20 to 25% meta-aramid of the Nomex brand.

Both Nomex, a meta-aramid, and Kevlar, a para-aramid, are heat and flame resistant and have been used extensively because of these properties.

In the best mode of the invention, a woven fabric about 60" wide comprising 70% cotton, 20% meta-aramide, and 10% nylon is prepared. The fabric is stretched transversely in the fill direction as in FIG. 1 to a width of about 65". While in this stretched condition, the fabric is immersed in a bath containing 40% THPS, then squeezed through pad rollers so that wet pickup is between the range of 80 to 120% and dried so that the moisture content is in the range of 6 to 8%. Next, the fabric is treated with ammonia and then hydrogen peroxide. After washing, the fabric is tested to determine that it meets the ASTM standards In another preferred embodiment, the fabric of the above described best mode includes sufficient carbon/polyester fibers in the fill to impart anti-static properties to the fabric. Specifically, it is preferred that a carbon fiber be the core of a yarn strand with a polyester covering sheath.

In the specification above, there has been set forth a preferred embodiment of the invention and although specific terms are employed, they are used in a generic and descriptive sense and not for purposes of limitation, the scope of the invention being defined by the claims that follow.

We claim:

1. A finished fabric with warp and fill yarns comprising a blend of cotton and thermoset fibers wherein said finished fabric has original dimensions in an unstretched condition, said finished fabric having been totally immersed in a bath solution containing a concentration of 25% to 40% of tetrakis hydroxymethyl phosphonium sulphate (THPS), while at least one of the warp and fill yarns are in a transverse stretched condition during immersion wherein the transverse stretched condition precludes longitudinal stretching and wherein the transverse stretched condition is from 5% to 12% greater than the original dimensions in an unstretched condition of the finished fabric, and while so transverse stretched, applying the flame retardant to the fabric and then allowing the fabric to shrink back to its original dimensions wherein the fabric receives its flame retardant treatment while stretched, so that said cotton fibers are opened and more thoroughly and evenly penetrated with said THPS, providing a more permanent and durable fire retardant apparel finished fabric comprising from 1.5% to 4.0% phosphorous content, and able to withstand repeated uses and washings, wherein the said THPS is evenly deposited in the finished fabric and the finished fabric has flame resistant characteristic of a char length of less than 6 inches in accordance with the ASTM F1506 test after the finished fabric has been washed according to Underwriters Laboratories 100IL (industrial laundering).

2. The finished fabric of claim 1 wherein the fabric comprises at least 60% cotton and at least 10% thermoset fibers.

3. The finished fabric of claim 1 including carbon filaments in the fill for imparting anti-static properties to the fabric.

4. The finished fabric of claim 1 wherein said fabric is stretched in the fill direction.

5. The finished fabric of claim 1 wherein said fill and warp yarns are stretched.

6. A finished fabric comprising:

a) at least 60% cotton and at least 10% thermoset material;

b) said finished fabric having original dimensions in an unstretched condition and having been stretched in the transverse direction to between about 5% and about 12% greater than the original dimensions in an unstretched condition of the cotton material to open the finished fabric for treatment wherein the transverse stretched condition precludes longitudinal stretching and while so transverse stretched, applying the flame retardant to the finished fabric and then allowing the finished fabric to shrink back to its original dimensions wherein the fabric receives its flame retardant treatment while stretched; and c) said stretched fabric having been immersed in a flame retardant solution containing tetrakis hydroxymethyl phosphonium sulphate (THPS) so that said opened cotton material is more thoroughly and evenly penetrated by said fire retardant solution; wherein said THPS is evenly deposited in the finished fabric, and wherein the finished fabric has flame resistant characteristic of a char length of less than 6 inches in accordance with the ASTM F1506 test after the finished fabric has been washed according to Underwriters Laboratories 100IL (industrial laundering).

* * * * *